US008534295B2

(12) United States Patent
Gonsalves

(10) Patent No.: US 8,534,295 B2
(45) Date of Patent: Sep. 17, 2013

(54) PIPE AND SMOKING KIT

(76) Inventor: Martin T. Gonsalves, Antioch, CA (US)

( * ) Notice: Subject to any disclaimer, the term of this patent is extended or adjusted under 35 U.S.C. 154(b) by 620 days.

(21) Appl. No.: 12/410,334

(22) Filed: Mar. 24, 2009

(65) Prior Publication Data

US 2009/0235939 A1 Sep. 24, 2009

Related U.S. Application Data

(60) Provisional application No. 61/038,831, filed on Mar. 24, 2008.

(51) Int. Cl.
*A24F 1/28* (2006.01)

(52) U.S. Cl.
USPC ..... 131/191; 131/202

(58) Field of Classification Search
USPC ..... 131/191, 202
See application file for complete search history.

(56) References Cited

U.S. PATENT DOCUMENTS

| | | | | | |
|---|---|---|---|---|---|
| 34,585 | A | | 3/1862 | Milne | |
| 140,360 | A | | 3/1873 | Gedies | |
| 711,691 | A | | 4/1902 | Barger | |
| 732,252 | A | * | 6/1903 | Assman | 131/191 |
| 848,415 | A | * | 3/1907 | Vogelsang | 131/191 |
| 882,825 | A | | 3/1908 | Heald | |
| 959,043 | A | | 5/1910 | Barger | |
| 1,272,389 | A | | 7/1918 | Cooper | |
| 1,388,733 | A | | 8/1921 | McGuckin | |
| 1,674,617 | A | * | 6/1928 | De Benedictis | 131/191 |
| 2,024,865 | A | * | 12/1935 | Mcardle | 131/198.1 |
| 2,124,130 | A | | 7/1938 | Van Deventer | |
| 2,135,179 | A | * | 11/1938 | Hudes | 131/176 |
| 2,342,853 | A | * | 2/1944 | Furstenberg | 128/202.21 |
| 2,686,524 | A | * | 8/1954 | Kershaw, Sr. et al. | 131/211 |
| 2,779,340 | A | * | 1/1957 | Mansfield | 131/175 |
| 3,270,751 | A | | 9/1966 | Tucker | |
| 3,709,233 | A | * | 1/1973 | Stelitano | 131/176 |
| 3,713,452 | A | | 1/1973 | D'Elia et al. | |
| 4,080,972 | A | | 3/1978 | Furlow | |
| 4,116,204 | A | | 9/1978 | Kline | |
| 4,135,522 | A | | 1/1979 | Hendricks | |
| 4,151,849 | A | | 5/1979 | Beck | |
| 4,214,658 | A | | 7/1980 | Crow | |
| 4,275,747 | A | * | 6/1981 | Miller | 131/195 |
| 4,328,795 | A | | 5/1982 | Cabaniss, III | |
| 4,596,258 | A | | 6/1986 | Steiner | |
| 4,788,988 | A | | 12/1988 | Titus | |
| 5,417,227 | A | | 5/1995 | West | |
| 5,819,756 | A | | 10/1998 | Mielordt | |
| 6,196,232 | B1 | | 3/2001 | Chkadua | |
| 6,260,554 | B1 | | 7/2001 | Rowland et al. | |

* cited by examiner

*Primary Examiner* — Richard Crispino
*Assistant Examiner* — Dionne Walls Mayes
(74) *Attorney, Agent, or Firm* — Stuart J. West; Shaun Sluman; West & Associates, A PC

(57) ABSTRACT

A linear pipe adapted to selectively receive a desired smoking substance and contain said substance in a smoldering/smoking state such that a user can selectively smoke the substance. In some embodiments the pipe can include a retaining cap adapted to further contain the smoking substance. In some embodiments the exterior of the linear pipe can include various adornments to effect a desired appearance.

17 Claims, 13 Drawing Sheets

PIPE AND SMOKING KIT

CLAIM OF PRIORITY

The following application claims priority to U.S. Provisional Patent Application No. 61/038,831, filed Mar. 24, 2008, the complete contents of which are hereby incorporated by reference.

BACKGROUND

1. Field of the Invention

The present disclosure relates to the field of smoking devices and kits, specifically a pipe for use with loose or packed tobacco, and a kit comprising the pipe and a variety of tobacco products.

2. Background

Tobacco smoking has been enjoyed by humans for thousands of years and is a favorite pastime for some. Tobacco can be enjoyed in the form of loose leaves, cigars, and cigarettes, among other forms. Pipes have been utilized as a traditional method of smoking loose tobacco leaves; however it can be difficult or impossible to use other forms of tobacco with the pipe smoking systems that are currently on the market. Moreover, if one desires to smoke only a small portion of prepacked tobacco, such as a cigar or cigarette, the lit tobacco must be put out and relit at a later time, a method that can prove inconvenient or undesirable. For example, many cigars are sold pre-wrapped in order to maintain freshness, smell, and flavor. Thus, if only a small portion is smoked, the smoker must find a way to re-wrap the cigar in order to preserve its quality, a task that can be difficult, inconvenient, or impossible.

There are also many instances where a person prefers to try a certain type or flavor of packed tobacco without buying or using an entire cigar. It is desirable to be able to use truncated portions of cigars and cigarettes, in addition to loose tobacco leaves, with a pipe device. However, there are no devices that can effectively accomplish this goal. As a result, few cigar or cigarette retailers will sell individual truncated portions of rolled tobacco.

Currently, most pipes have a "L" shape such that tobacco can be packed into and stored in a smoking chamber that remains substantially vertical when a user is actively engaged in smoking. Such a design creates problems with cleaning due to the bend in the tube between the tobacco chamber and end through which the user draws the smoke. Most pipes are designed with the vertical component to prevent the tobacco from falling out of the end of the pipe. Commonly, tobacco burns in a non-uniform manner, causing a non-uniform flow of smoke through traditional pipes. Most pipes lack a separate smoke chamber that can collect and evenly distribute smoke prior to entering a user's mouth.

It is desirable to have a smoking pipe that is substantially linear. In some instances, a pipe should resemble the size, color, and/or texture of a cigar. The pipe should have a compartment for housing a portion of a smokable substance, such as a cigar piece, and a cap to prevent the substance from falling out of the pipe. It is also desirable to have a smoke chamber that allows smoke to collect and distribute evenly prior to entering a user's mouth. The pipe should have at least one filter to prevent large particles from entering a user's mouth. It may also be desirable to have a removable and/or disposable mouthpiece. In some embodiments, it can be desirable to have small metal filaments at one end of the pipe that, when heated, can produce a glow similar to the lit end of traditional cigar or cigarette.

DETAILED DESCRIPTION

Figure 1:
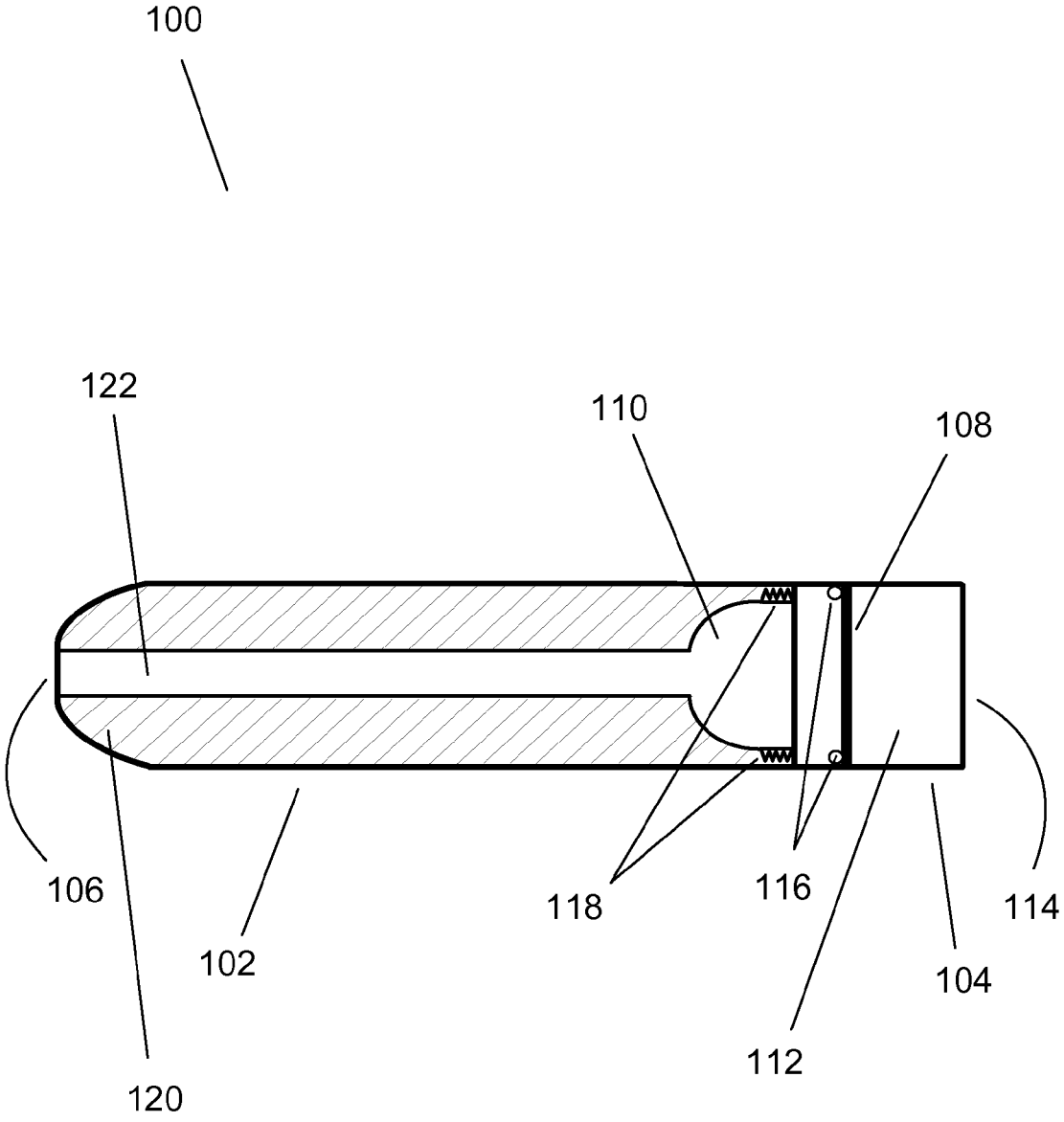
FIG. 1 depicts a longitudinal cross-sectional view of one embodiment of the present device.

FIG. 1 depicts a longitudinal cross-sectional view of one embodiment of a smoking pipe 100. A pipe 100 can comprise a mouthpiece end 106 and an air intake end 114. A mouthpiece end 106 and an air intake end 114 can be operatively coupled such that if a suction source is applied to the mouthpiece end 106, suction is applied at the air intake end 114, generating a suction force in the direction of the mouthpiece end 106.

A pipe 100 can further comprise a first tubular member 102 having a proximal end located at or near the mouthpiece end 106, and a distal end located at or near the air intake end 114. A substantially centrally located bore 122 can extend through both the proximal and distal ends of the first tubular member 102. A first tubular member 102 can have a circular or elliptical cross-section, or can have any other known and/or convenient geometry. Likewise, a bore 122 can have a circular or elliptical cross-section, or can have any other known and/or convenient geometry. The diameter of a bore 122 through a first tubular member 102 can be uniform in size along the entire length of the first tubular member 102. In other embodiments, the diameter of a bore 122 at one point along the length of a first tubular member 102 can have a different size than the diameter at another point. By way of non-limiting example, FIG. 1 illustrates a bore 122 having uniform diameter size along a substantial portion of the length of a first tubular member 102, but proximate to the air intake end 114 of a pipe 100, the diameter of the bore 122 increases in size to define a smoke chamber 110. In alternate embodiments, a bore 122 can have any other known and/or convenient geometry.

A first tubular member 102 can be made of a rigid or semi-rigid material or combinations of materials. FIG. 1 depicts a first tubular member 102 comprised of ceramic, however in alternate embodiments the material can be glass, metal, wood, polymer or any other known and/or convenient material or combination of materials. A first tubular member 102 also be made of insulating material to maintain the temperature within a pipe 100 and/or prevent excessive heat transfer to a user's hand. Moreover, the surface of a first tubular member 102 can have insulating properties, such as being coated with a layer of heat-resistant silicone to prevent heat transfer to a user's hand. In other embodiments, the surface of a first tubular member 102 can have ridges, protrusions, or any other known and/or convenient surface characteristic that can provide desired anti-slip and/or aesthetic qualities. In yet other embodiments, the surface of a first tubular member 102 can have anti-bacterial properties. A first tubular member 102 can be substantially brown in color to resemble a cigar, as described below, or can have any other known and/or convenient color or combination of colors.

Figure 6:
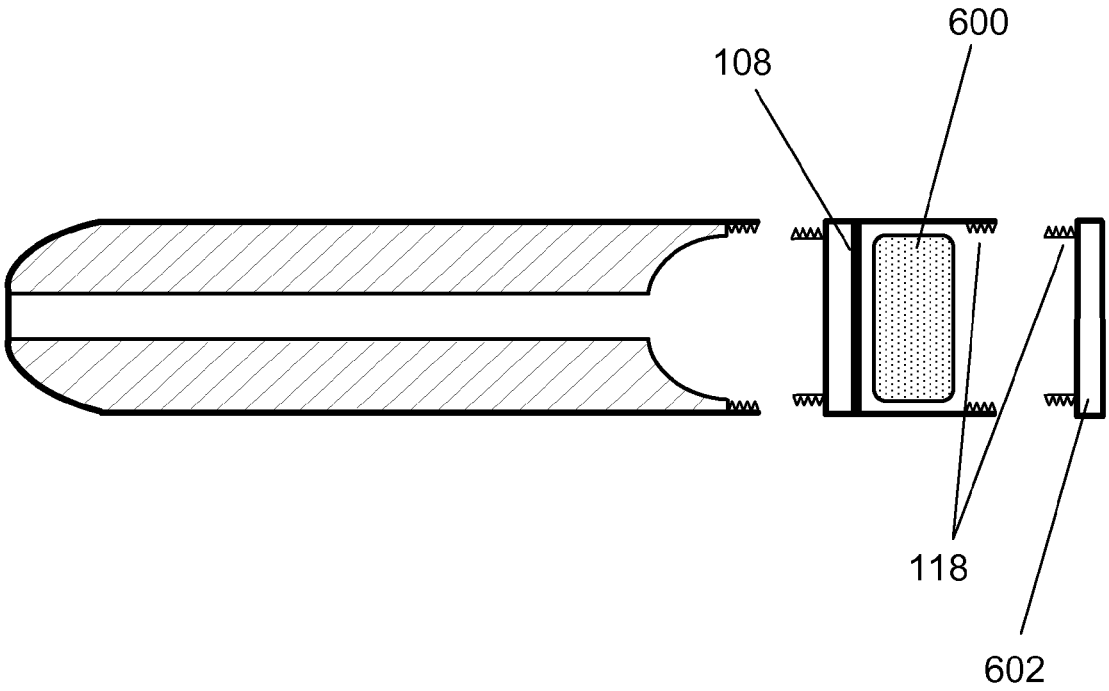
FIG. 6 depicts a longitudinal cross-sectional view of an embodiment of the present device, showing a detachable second tubular member and a detachable retaining cap.

A second tubular member 104 can be coupled with a first tubular member 102 proximate to the air intake end 114 of a pipe 100. The exterior diameter of a second tubular member 104 can be substantially similar to the exterior diameter of a first tubular member 102, as shown in FIG. 1. In some embodiments, the exterior diameter of a second tubular member 104 can be substantially similar to the interior diameter of a second tubular member 104, defining a thin wall in comparison to the wall of a first tubular member 102. In other embodiments, the walls of first and second tubular members 102 104 can be substantially similar in thickness. As depicted in FIG. 1, the wall of a second tubular member 102 can define a substance chamber 112 adapted to frictionally engage a desired smokable substance 600. By way of non-limiting example and as shown in FIG. 6, a smokable substance 600 housed within a second tubular member 104 can be a truncated portion of a cigar. In other embodiments, a smokable substance 600 can be a portion of a cigarette, loose tobacco, or any other known and/or desired substance dimensioned to fit within the walls of a second tubular member 104.

A second tubular member 104 can be made of a rigid or semi-rigid material or combinations of materials. FIG. 1 depicts a second tubular member 104 comprised of ceramic, however in alternate embodiments the material can be glass, metal, wood, polymer or any other known and/or convenient material or combination of materials. First and second tubular members 102 104 can be made of the same material or combination of materials, or can be comprised of different materials. Moreover, the surface of a second tubular member 104 can have insulating properties, such as being coated with a layer of heat-resistant silicone to prevent heat transfer to a user's hand. In other embodiments, the surface of a second tubular member 104 can have ridges, protrusions, or any other known and/or convenient surface characteristic that can provide desired anti-slip and/or aesthetic qualities. In yet other embodiments, the surface of a second tubular member 104 can have anti-bacterial properties. A second tubular member 104 can be substantially brown in color to resemble a cigar, as described below, and/or can be the same color as a first tubular member 102. In other embodiments, a second tubular member 104 can have any other known and/or convenient color or combination of colors.

Figure 2:
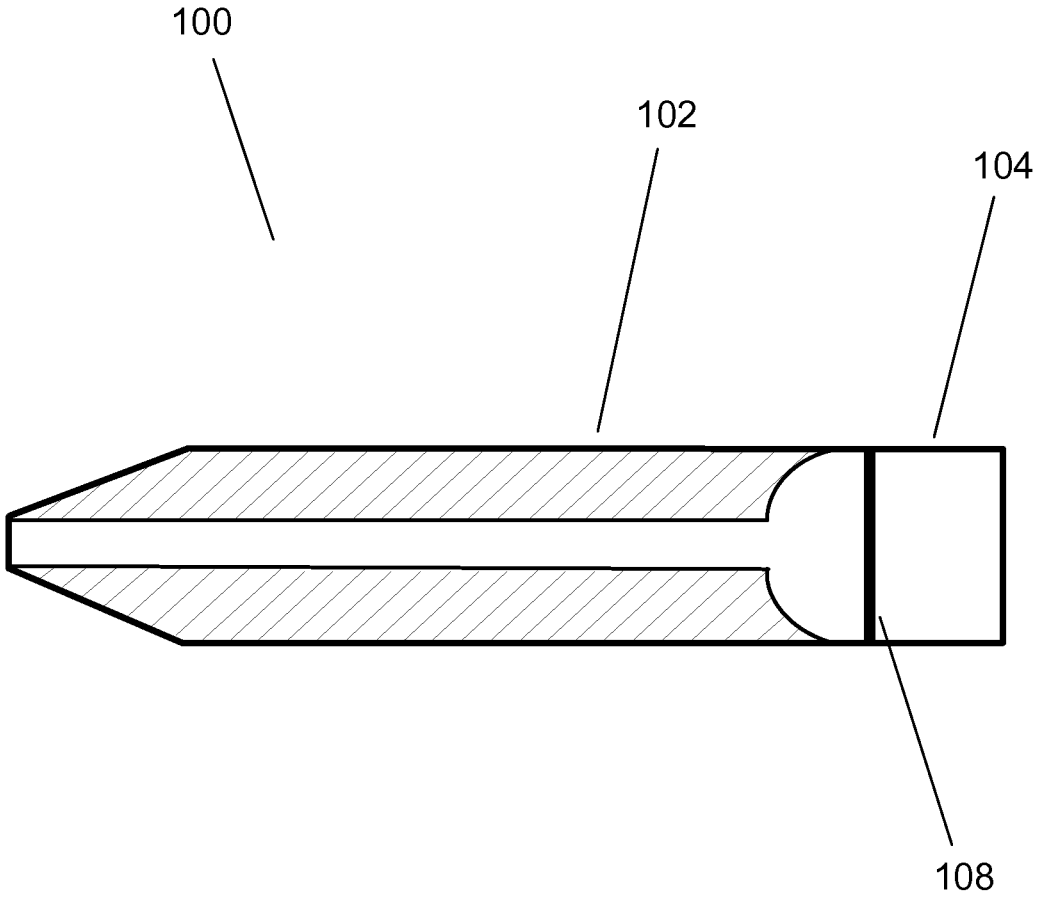
FIG. 2 depicts a longitudinal cross-sectional view of another embodiment of the present device, showing a mouthpiece and second tubular member as permanently coupled with a first tubular member.

The proximal end of a second tubular member 104 can be coupled with the distal end of a first tubular member 102 in a selectively detachable manner via a first set of complementary fastening components 118. In FIG. 1, first and second tubular members 102 104 are coupled via complementary threaded members 118, with the first tubular member 102 being coupled with a female fastening member 118, and the second tubular member 104 being coupled with a male fastening member 118. In other embodiments, first and second tubular members 102 104 can be detachably coupled via a press-fit mechanism or any other known and/or convenient manner and/or mechanism for detachably coupling first and second tubular members 102 104. In other embodiments, as shown in FIG. 2, first and second tubular members 102 104 can be permanently coupled.

Figure 5:
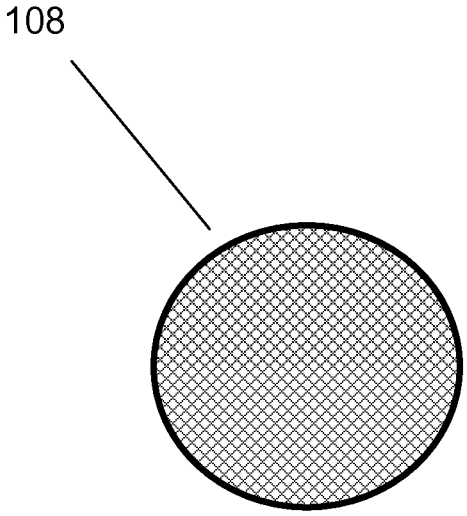
FIG. 5 depicts a view of one surface of a filter member.

The interior surface of a second tubular member 104 can be coupled with a first filter member 108 that can prevent large, unwanted particles of a smokable substance from entering a smoke chamber 110 and a bore 122. In some embodiments and as shown in FIG. 1, a filter member 108 can be positioned close to the proximal end of a second tubular member 104 such that the smoke of a burning smokable substance 600 can pass through the filter member 108 when in use. As shown in FIG. 5, a filter member 108 can comprise a metal meshwork, the openings of which can be any known and/or convenient size. In other embodiments, a filter member can be made of heat-resistant plastic or any other known and/or convenient material or combination of materials. A filter member 108 can be substantially planar or can have curved surfaces. A filter member 108 can also be comprised of one meshwork layer, or can be comprised of a plurality of parallel meshwork layers. A filter member 108 can be permanently coupled with a second tubular member 104, or can be removable for disposal or cleaning purposes. A filter member 108 can be a single-use, disposable component, or can be used multiple times. Moreover, a filter member 108 can be embedded with any desired flavoring to impart flavor in the smoke when a pipe 100 is in use.

At least one support component 116 can be coupled with a second tubular member 104 in order to prevent unwanted movement or shifting of a filter member 108. As shown in FIG. 1, support components 116 can be small spherical members permanently coupled with the interior wall of a second tubular member 104, which prevent the filter member 108 from moving toward the proximal end of the second tubular member 104. In other embodiments, at least one support component 116 can have any other known and/or convenient geometry, and can be located at any other known and/or convenient point within a pipe 100.

Figure 3:
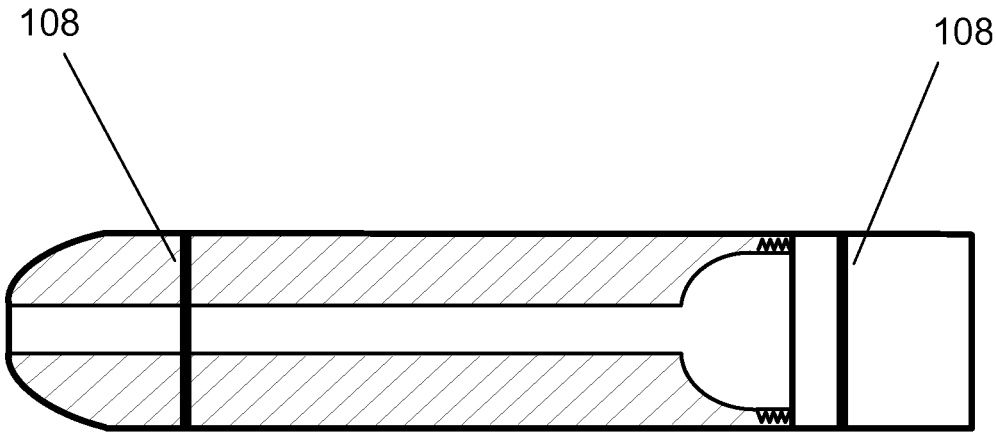
FIG. 3 depicts a longitudinal cross-sectional view of an alternate embodiment of the present device, showing two filter members.
Figure 7:
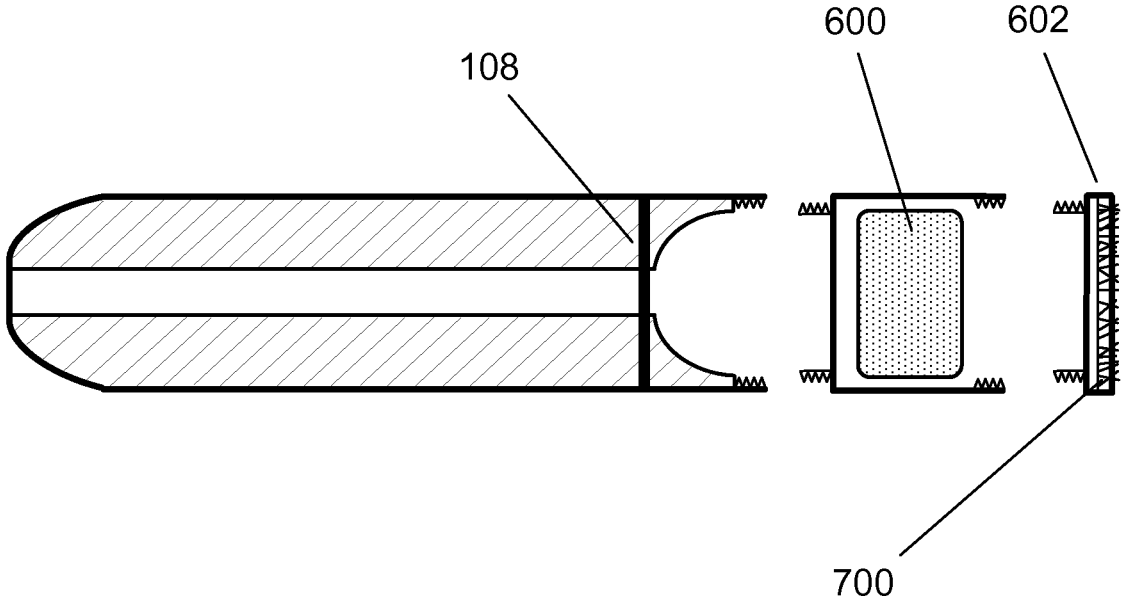
FIG. 7 depicts a longitudinal cross-sectional view of another embodiment of the present device, showing the addition of filament members to a detachable retaining cap.

As illustrated in FIG. 3, a pipe 100 can comprise a second filter member 108 coupled with a first tubular member 102 and extending through a latitudinal plane of the pipe 100. As shown in FIG. 7, a second tubular member 104 can be devoid of filter members 108, and a first tubular member 102 can comprise a first filter member 108 located at the proximal end of a smoke chamber 110. In other embodiments, a pipe 100 can comprise any other known and/or convenient number of filter members 108 at any known and/or convenient locations within a pipe 100.

A pipe 100 can further comprise a mouthpiece 120 coupled with the proximal end of a first tubular member 102. A bore 122 can extend through a mouthpiece 120, forming an opening such that a user can create suction through the pipe 100 in the direction of the mouthpiece end 106. As shown in FIG. 1, a mouthpiece 120 can have a substantially rounded shape. In other embodiments, such as in FIG. 2, a mouthpiece can have a substantially conical geometry. In alternate embodiments, a mouthpiece 120 can have any other known and/or convenient geometry.

Figure 4:
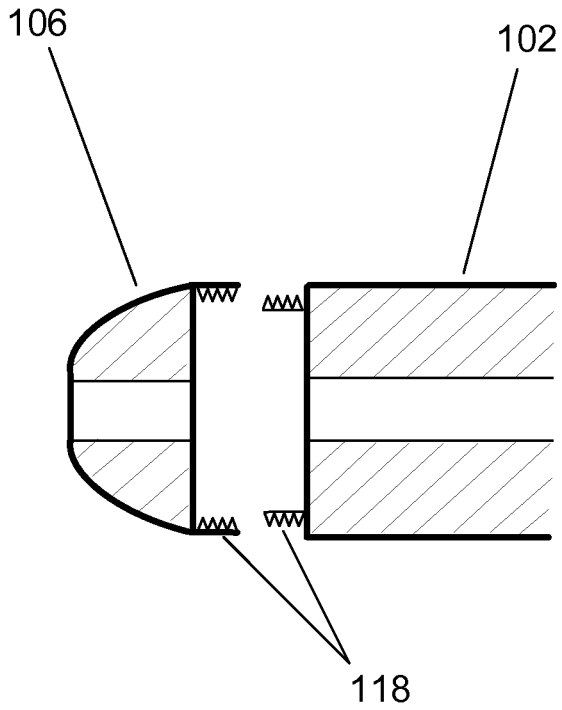
FIG. 4 depicts a longitudinal cross-sectional view of the proximal end of an embodiment of the present device, showing a detachable mouthpiece.

As depicted in FIGS. 1-3, a mouthpiece 120 can be permanently coupled with a first tubular member 102. In other embodiments, and as illustrated in FIG. 4, a mouthpiece 120 can be detachably coupled with a first tubular member 102 via a second set of complementary fastening components 118. In FIG. 4, a first tubular member 102 is coupled with a male threaded member 118 adapted to mate with the female threaded member 118 coupled with the mouthpiece 120. In other embodiments, a mouthpiece 120 can be detachably coupled with a first tubular member 102 via a press-fit mechanism or any other known and/or convenient mechanism or method.

A mouthpiece 120 can be made of ceramic, metal, plastic, glass, cardboard, polymer or any other known and/or convenient type of material or combination of materials. A mouthpiece 120 and first tubular member 102 can be comprised of the same material or combination of materials, or can be made of different materials. The material of a mouthpiece 120 can be food-grade and/or can have anti-bacterial properties. Moreover, a mouthpiece 120 can be reusable and/or washable, or can be disposable and/or single-use. In some embodiments, a first tubular member 102 can be adapted to mate with interchangeable mouthpieces 120 having a variety of sizes and geometries.

A bore 122 in a first tubular member 102 can define a smoke chamber 110 at one end, as shown in FIGS. 1-3, 6-7. A smoke chamber 110 can have curved walls adapted to collect smoke from a burning smokable substance 600 and allow it to evenly distribute before it funnels into the rest of a bore 122 and flows through a mouthpiece 120. In other embodiments, a smoke chamber 110 can have any other known and/or convenient geometry.

As explained above, a second tubular member 104 can define a substance chamber 112 adapted to hold a smokable substance 600. As shown in FIG. 6, the air intake end 114 of a pipe 100 can further comprise a retaining cap 602 that can detachably couple with the distal end of a second tubular member 104. A retaining cap 602 can be adapted to prevent a smokable substance 600 from falling out of a pipe 100, while still allowing air to flow through the air intake end 114 when suction is applied.

Figure 8A:
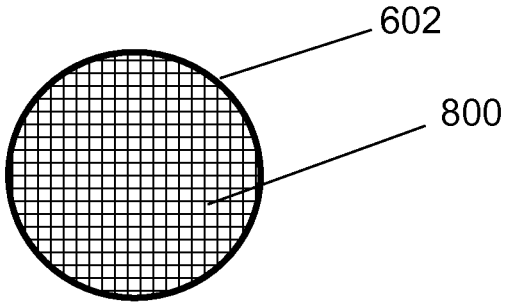
FIG. 8 depicts a front surface view of several embodiments of a detachable retaining cap.
Figure 8B:
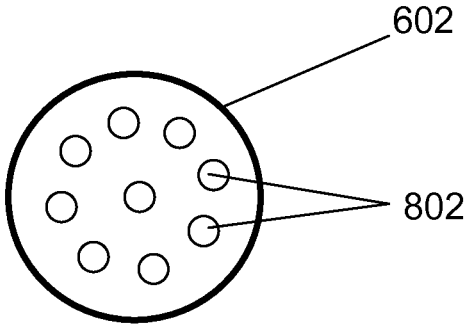
Figure 8C:
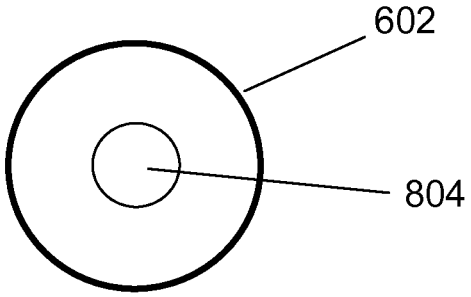

FIG. 8 illustrates a front surface view of several embodiments of a retaining cap 602. In one embodiment, as shown in FIG. 8*a*, a retaining cap 602 can be comprised of a meshwork 800. In another embodiment, as shown in FIG. 8*b*, a retaining cap 602 can have a plurality of small circular apertures 802. In yet another embodiment, as shown in FIG. 8*c*, a retaining cap 602 can have one aperture positioned substantially through its center. In alternate embodiments, a retaining cap 602 can have any other known and/or convenient geometry or characteristics appropriate for retaining a smokable substance 600 within a second tubular member 104 while also allowing air to pass through.

A retaining cap 602 can be made of ceramic, metal, glass, wood, cardboard, polymer or any other known and/or convenient material or combination of materials. A retaining cap 602 can be made of the same material as at least one of a first tubular member 102, second tubular member 104, and mouthpiece 120. In addition, a retaining cap 602 can have any known and/or convenient color, or any known and/or convenient surface characteristics.

A retaining cap 602 can be detachably coupled with a second tubular member 104 via a third set of complementary fastening components 118. In FIG. 6, complementary fastening components 118 are male and female threaded members. In other embodiments, a retaining cap 602 and second tubular member 104 can be coupled via a press-fit mechanism or any other known and/or convenient method or mechanism.

FIG. 7 depicts another embodiment of a pipe 100. The air intake end 114 can be coupled with a plurality of small metal filaments that can emit visible electromagnetic waves when heated to a desired temperature. By way of non-limiting example, at high temperatures, nickel-chromium wire can produce a yellow-orange glow similar to the color produced by the end of a burning cigar or cigarette. Thus, when properly positioned, a plurality of small metal filaments coupled with the air intake end 114 of a pipe 100 can substantially mimic the end of a burning cigar or cigarette. In FIG. 7, a plurality of metal filaments 700 are coupled with and substantially perpendicular to a retaining cap 602. These metal filaments 700 also extend slightly past the air intake end 114 of the pipe 100, but in other embodiments they can be entirely contained within a retaining cap 602. The metal filaments 700 shown in FIG. 7 are coupled with a retaining cap 602 via attachment to a meshwork, however in other embodiments metal filaments 700 can be coupled with the air intake end 114 of a pipe 100 in any other known and/or convenient manner.

Figure 9:
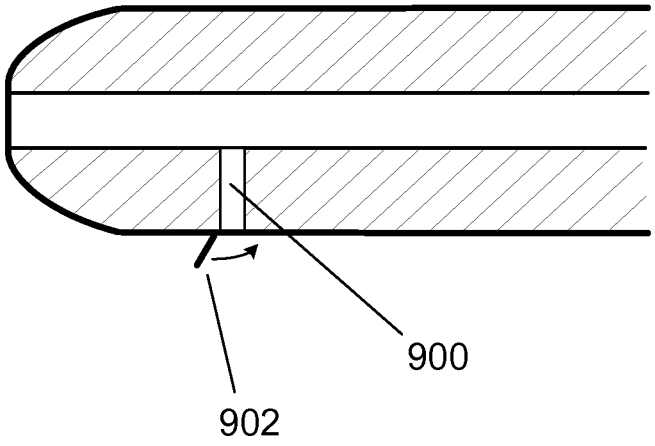
FIG. 9 depicts a longitudinal cross-sectional view of the proximal end of one embodiment of the present device, showing a carburetion aperture.

A first tubular member 102 can further comprise a carburetion aperture 900 extending from the exterior of the first tubular member 102 through to the bore 122, as depicted in FIG. 9. A carburetion aperture 900 can allow a user to control the amount of air that can be mixed with smoke from a smokable substance 600 in a bore 122 prior to entering the mouth of a user. A carburetion aperture 900 can be located at any convenient point along the length of a first tubular member 102. In some embodiments, as shown in FIG. 9, a carburetion aperture 900 can be coupled with a hinged cover 902 that can be used to selectively allow passage of air through the carburetion aperture 900. In other embodiments, a cover 902 can be slidably coupled with a carburetion aperture 900. In yet alternate embodiments, a cover 902 can be a plug that can tightly fit within a carburetion aperture 900 to block the passage of air. A user can also use a finger as a cover 902 to selectively block the opening of a carburetion aperture 900. In other embodiments, a cover 902 can be any other known and/or convenient mechanism for selectively blocking the passage of air through a carburetion aperture 902.

Figure 10:
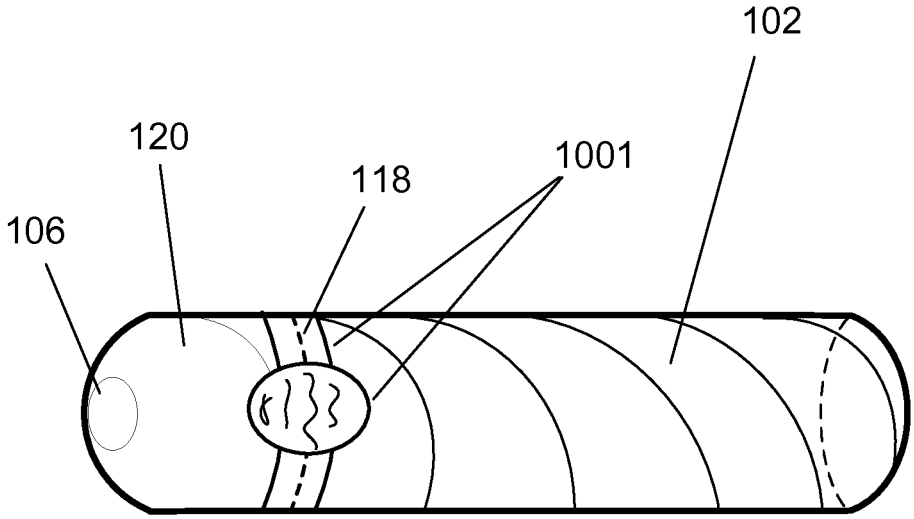
FIG. 10 depicts a side view of an embodiment of the present device.

FIG. 10 depicts a side perspective view of a pipe 100. A label 1001 can be positioned over the surface of a smoking pipe 100 substantially proximate to a mouthpiece end 106. As shown in FIG. 10, a label 1001 can extend around the entire circumference of a pipe 100. In other embodiments, a label 1001 can extend only partially around the circumference, and/or can be positioned at any other location along the exterior of the pipe 100. At least one label 1001 can be positioned such that it can conceal a joint between a first tubular member 102 and one or both of a mouthpiece 120 and a second tubular member 104. As shown in FIG. 10, a label 1001 can be partially permanently coupled with a first tubular member 102, and the underside of a label 1001 can be a complementary fastening component 118 adapted to mate with a mouthpiece 120 in a press-fit fashion. In other embodiments, a mouthpiece 120 can mate with a label 1001 in a screw-on manner, or via any other known and/or convenient mechanism.

A label 1001 can be permanently or temporarily coupled with a pipe 100. In some embodiments, a label 1001 can be made of paper and can be bonded to a pipe 100 using adhesive. In other embodiments, a label 1001 can be made of flexible metal, polymer, cardboard, or any other known and/or convenient material. In some embodiments, a label can be comprised of insulating material, such as silicone, in order to provide a heat-resistant barrier between a user's fingers and the pipe 100. A label 1001 can also have ridges, indentations, or protrusions that can prevent a user's fingers from easily slipping from the label 1001. In yet other embodiments, a label 1001 can have anti-bacterial properties. A plurality of labels 1001 can be interchangeable and can depict identifying information and/or any desired images. In addition, labels 1001 can have any color or combination of colors.

Figure 11:
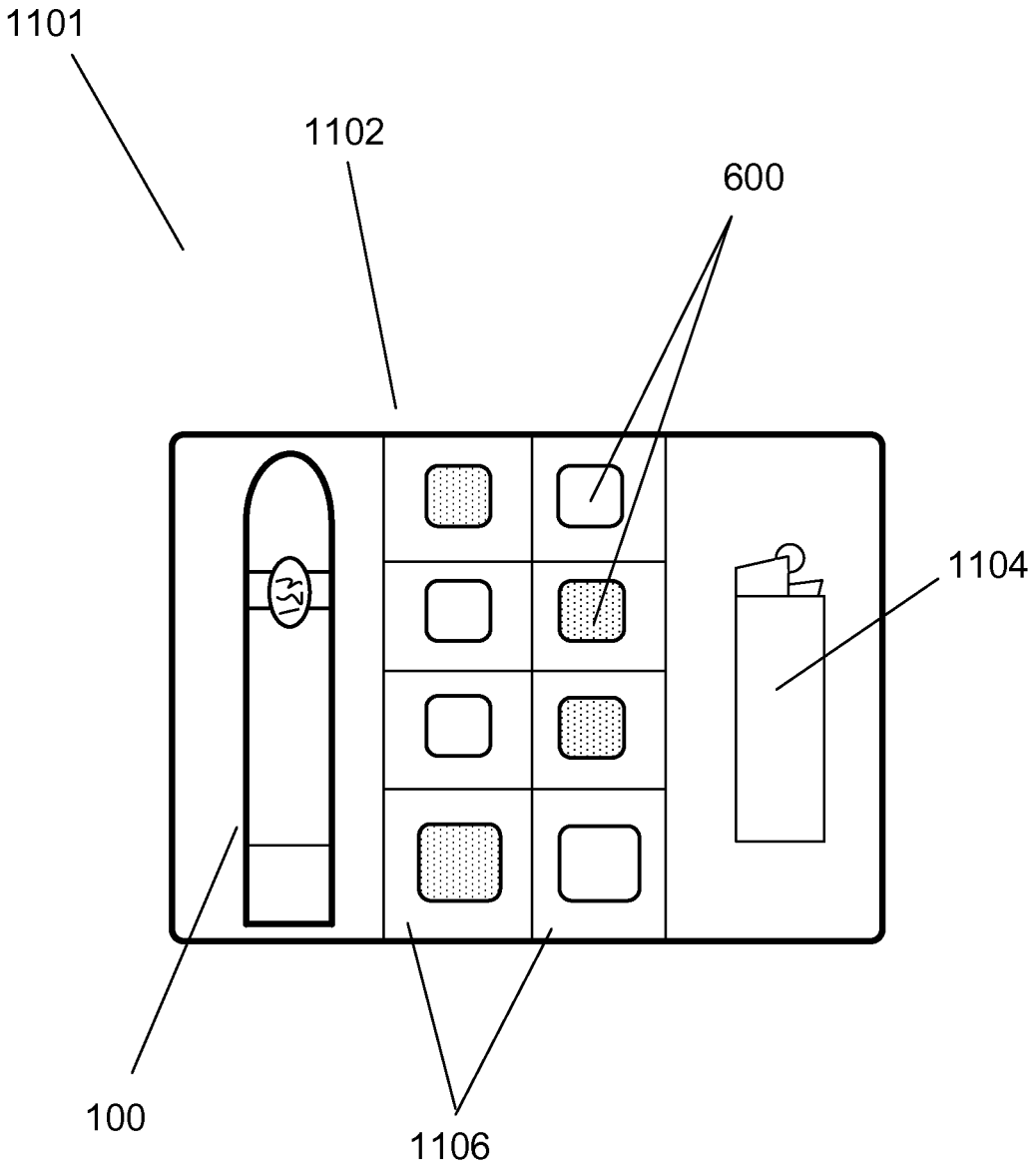
FIG. 11 depicts a top view of an embodiment of a kit comprising the present device, several portions of smokable products, and a lighter.

As shown in FIG. 11, a smoking kit 1101 can comprise a container 1102, a smoking pipe 100 and a plurality of smokable substances 600. In some embodiments a kit 1101 can further comprise a spark-producing device 1104 that can be used in conjunction with the smoking pipe and smokable substances 600. As illustrated in FIG. 11, a container 1102 can have a plurality of compartments 1106, each compartment 1106 adapted to house at least one of a plurality of smoking substances 600, a pipe 100, and a spark-producing device 1104. In some embodiments, a container 1102 can have one large compartment 1106 that can hold all components of the kit 1101. A plurality of smoking substances 600 can be truncated cigar pieces, cigarette pieces, loose tobacco, or any other known and/or convenient substance that can be burned and the smoke subsequently inhaled by a user. In some embodiments of a kit 1101, at least one smoking substance 600 can be of a different type than another smoking substance 600. By way of non-limiting example, smoking substances 600 can all be cigar pieces, but at least one cigar piece can have a different flavor than at least one other cigar piece. In other embodiments, smoking substances 600 can be a variety of cigar pieces and portions of loose tobacco. In alternate embodiments, a kit 1101 can have any other known and/or convenient composition of smoking substance 600.

A pipe 100 can be constructed to resemble a traditional cigar. First, a bore 122 can be formed through a piece of elongated material, creating a first tubular member 102. Second, a mouthpiece 120 can either be formed from and integral with the proximal end of the first tubular member 102, or can be made as a separate component that is subsequently permanently bonded to or detachably coupled with the proximal end of the first tubular member 102. Third, a second tubular member 102 can either be formed from and integral with the distal end of the first tubular member 102, or can be made as a separate component that is subsequently permanently bonded to or detachably coupled with the distal end of the first tubular member 102. Fourth, at least one piece of brown paper product, such as from a grocery bag, can be at least partially immersed in an adhesive mixture, such as but not limited to lacquer mixed with water. The brown paper product can then be applied to one end of the surface of a pipe 100 and wrapped around the circumference of the pipe 100 while moving toward the other end of the pipe 100 in a continuous manner, creating the wrapped effect shown in FIG. 10. This can create the appearance of a traditional cigar that is wrapped in tobacco leaves. In some embodiments, the brown paper product can be a single elongated strip that is applied to a pipe 100 in the aforementioned manner. A label 1001 can then be applied in any known and/or convenient manner, if desired. The above process is not limiting, and a pipe 100 can be made in any other known and/or convenient manner.

The exterior surface of a pipe 100 can have substantially the same color and/or texture as a traditional cigar, as explained above. In other embodiments, a pipe 100 can have substantially the same appearance as a cigarette. In yet other embodiments, the exterior surface of a pipe 100 can have any other known and/or convenient surface texture and/or color or combination of colors. A pipe 100 can be painted a solid color or can have painted designs and/or patterns. As explained above, a pipe 100 can be at least partially covered with brown paper product and adhesive, but in other embodiments a pipe 100 can be covered with different colored paper products or foil. In some embodiments, a mold can be used to simultaneously form a pipe 100 and create the desired surface texture and/or characteristics. Moreover, a pipe 100 can be made of a brown-colored material, thus eliminating the need to apply paint, paper, or any other products to make the pipe 100 resemble a traditional cigar. A pipe 100 can also be embellished with studs, gems, or any other known and/or convenient type of embellishment.

Figure 12:
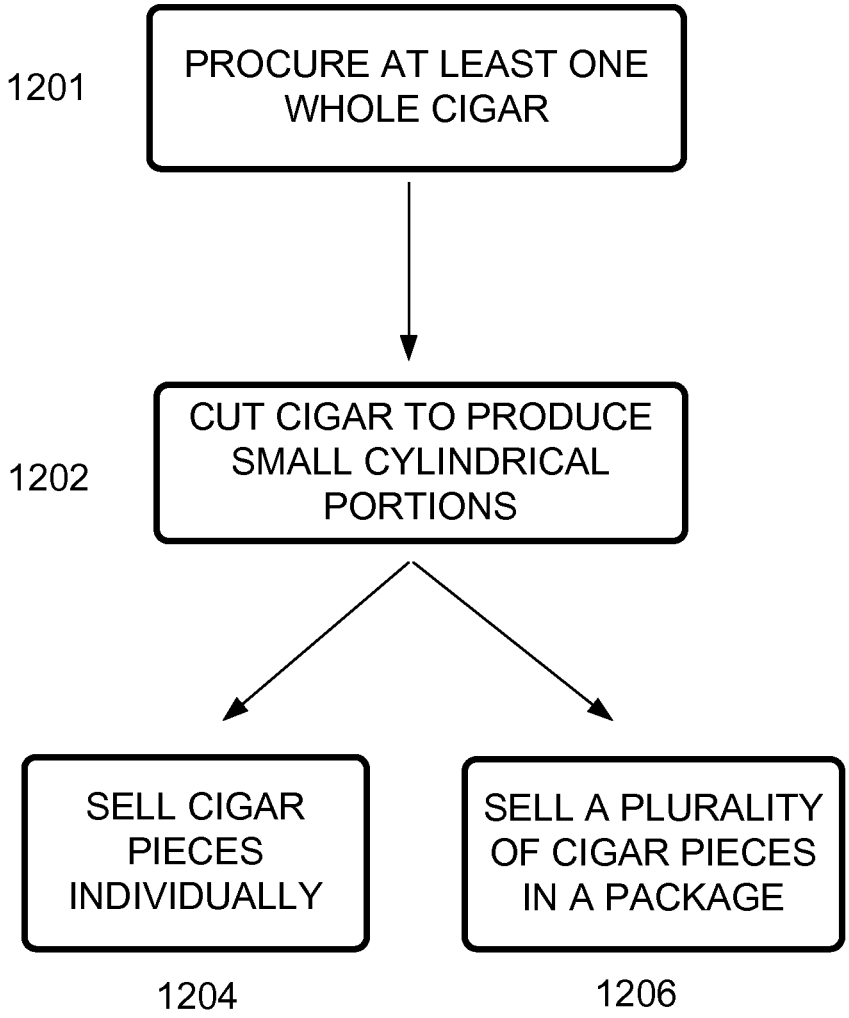
FIG. 12 depicts a method for producing and selling truncated cigar pieces.

In a retail context, truncated cigar portions can be sold for use in suitable smoking devices, as shown in FIG. 12. First, a person can procure at least one whole cigar 1201. Second, the cigar can be cut into small cylindrical members adapted to fit within the substance chamber of a desired smoking device 1202. Third, a merchant can sell the truncated cigar pieces individually 1204 and/or in packages containing a plurality of cigar pieces 1206.

Figure 13:
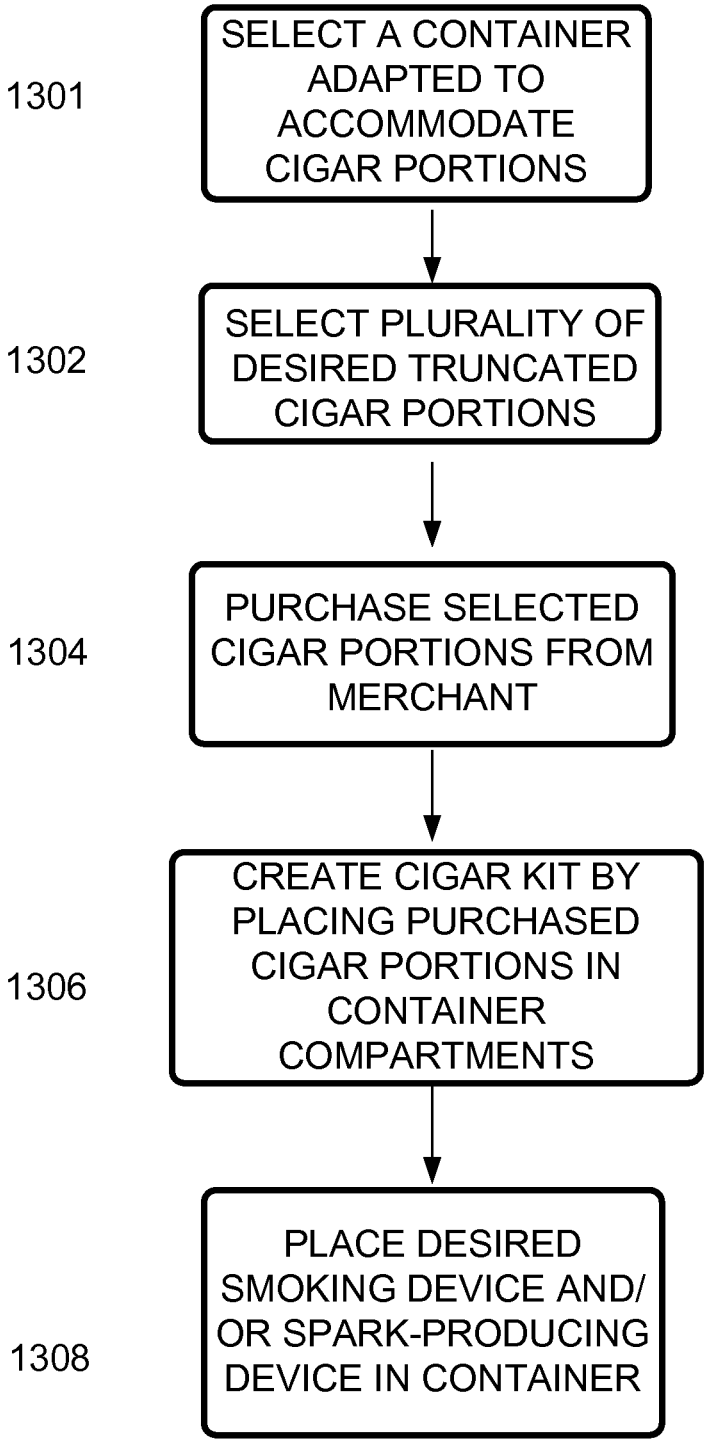
FIG. 13 depicts a method for creating a cigar kit.

In some embodiments and as shown in FIG. 13, a consumer and/or user can first select a container adapted to accommodate a plurality of truncated cigar portions 1301. Second, a consumer and/or user can select desired cigar pieces 1302 and purchase them from a merchant 1304. Third, the cigar pieces can be placed in the appropriate compartments of the chosen suitable container, thus creating a cigar kit 1306. A user can also store a desired smoking device, adapted to accommodate the cigar pieces, and a spark-producing device in the same container 1308.

In use, a smokable substance 600 can be inserted into a substance chamber 112 of a second tubular member 104. The proximal end of a second tubular member 104 can then be coupled with the distal end of a first tubular member 102 via a first set of complementary fastening components 118. A mouthpiece 120 can be coupled with the proximal end of a first tubular member 102 via a second set of complementary fastening components 118. When a user is ready to smoke the smokable substance 600, a flame or spark can be applied to the smokable substance 600 through the distal end of a second tubular member 104. Once lit, a retaining cap 602 can then be coupled with the distal end of a second tubular member 104 via a third set of complementary fastening components 118, thereby holding in place the burning smokable substance 600. A user can then bring the mouthpiece end 106 of the pipe 100 in contact with the mouth and inhale or otherwise produce a suction force in the direction of the mouth. This action causes the smoke from the smokable substance 600 to travel through a filter member 108 into a smoke chamber 110, through a bore 122, and into the mouth of the user.

In the foregoing specification, the embodiments have been described with reference to specific elements thereof. It will, however, be evident that various modifications and changes may be made thereto without departing from the broader spirit and scope of the embodiments. The specification and drawings are, accordingly, to be regarded in an illustrative rather than restrictive sense.

What is claimed is:

1. A smoking pipe, comprising:

a first tubular member comprising a mouthpiece and a first circular cylinder having straight sides along the entirety of its length, said first tubular member surrounding a bore extending entirely through said mouthpiece and said first circular cylinder;

a second tubular member comprising a second circular cylinder having straight walls along the entirety of its length that define a substance chamber within the interior of said second circular cylinder, the proximal end of said second tubular member being permanently coupled with the distal end of said first tubular member; and at least one filter member coupled with the interior of said second tubular member adjacent to the distal end of said first tubular member;

wherein said bore has a uniform diameter along its length from said mouthpiece through the majority of said first circular cylinder and has progressively larger diameters near the distal end of said first tubular member, and wherein the portions of said bore that have larger diameters than the uniform diameter form a smoke chamber.

2. The smoking pipe of claim 1, wherein said mouthpiece is integral with the proximal end of said first tubular member.

3. The smoking pipe of claim 1, wherein said mouthpiece is selectively detachable from the proximal end of said first tubular member.

4. The smoking pipe of claim 1, wherein said first tubular member is comprised of an inflexible material selected from the group consisting of: ceramic, wood, metal, polymer, and glass.

5. The smoking pipe of claim 1, wherein said substance chamber is adapted to house a smokeable substance.

6. The smoking pipe of claim 5, further comprising a selectively detachable retaining cap coupled with the distal end of said second tubular member, wherein said retaining cap is adapted to temporarily secure said smokeable substance within said substance chamber while allowing air to pass through said retaining cap.

7. The smoking pipe of claim 6, further comprising:

a plurality of metal filaments coupled with said retaining cap;

wherein said plurality of metal filaments are capable of emitting visible electromagnetic waves when heated to a desired temperature.

8. The smoking pipe of claim 1, further comprising at least one carburetion aperture extending from the exterior of said first tubular member to said bore.

9. The smoking pipe of claim 8, further comprising a cover coupled with the exterior surface of said first tubular member and adapted to selectively seal said carburetion aperture.

10. The smoking pipe of claim 1, further comprising a label coupled with the exterior surface of said first tubular member.

11. The smoking pipe of claim 10, wherein said label is comprised of a material selected from the group consisting of: paper, silicone, plastic and metal.

12. The smoking pipe of claim 1, wherein said at least one filter member can be selectively removed from the smoking pipe.

13. The smoking pipe of claim 1, further comprising at least one support component coupled with said at least one filter member and adapted to prevent movement of said filter member.

14. The smoking pipe of claim 1, further comprising a retaining cap coupled with the distal end of said second tubular member and having an exterior diameter substantially similar to the exterior diameter of said second tubular member.

15. The smoking pipe of claim 1, wherein said first tubular member is comprised of a different material than said second tubular member.

16. The smoking pipe of claim 15, wherein said first tubular member is comprised of wood and said second tubular member is comprised of metal.

17. The smoking pipe of claim 16, further comprising a wrapping bonded to the exterior surface of said mouthpiece and the straight exterior sides of said first tubular member and said second tubular member.

* * * * *